US008957341B2

(12) United States Patent
Zhang et al.

(10) Patent No.: US 8,957,341 B2
(45) Date of Patent: Feb. 17, 2015

(54) GAS CIRCUIT BREAKER

(71) Applicant: Hitachi, Ltd., Tokyo (JP)

(72) Inventors: Wei Zhang, Hitachi (JP); Masanori Tsukushi, Hitachi (JP); Tomoyuki Ando, Hitachi (JP); Michiru Onodera, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 214 days.

(21) Appl. No.: 13/711,064

(22) Filed: Dec. 11, 2012

(65) Prior Publication Data

US 2013/0161290 A1 Jun. 27, 2013

(30) Foreign Application Priority Data

Dec. 22, 2011 (JP) ..... 2011-280704

(51) Int. Cl.
*H01H 33/00* (2006.01)
*H01H 33/42* (2006.01)
*H01H 33/24* (2006.01)

(52) U.S. Cl.
CPC ..... *H01H 33/42* (2013.01); *H01H 33/24* (2013.01)
USPC ..... 218/43; 218/69; 218/135; 218/144

(58) Field of Classification Search
USPC ..... 218/43, 69, 135, 144
See application file for complete search history.

(56) References Cited

U.S. PATENT DOCUMENTS 3,899,650 A * 8/1975 Kishi et al. ..... 218/60
3,946,184 A * 3/1976 Yoshioka et al. ..... 218/82
4,101,748 A * 7/1978 Meyer et al. ..... 218/69
4,251,701 A * 2/1981 Meyer ..... 218/59
4,307,273 A * 12/1981 Sasaki et al. ..... 218/43
4,433,293 A * 2/1984 Aoyagi et al. ..... 324/424
4,434,333 A * 2/1984 Kawasaki ..... 218/144
5,191,180 A * 3/1993 Kitamura et al. ..... 218/135
5,483,031 A 1/1996 Matsuda
5,495,084 A * 2/1996 Meyer et al. ..... 218/43

(Continued)

FOREIGN PATENT DOCUMENTS

CN 1087202 A 5/1994
CN 1117199 A 2/1996
CN 2224460 Y 4/1996
CN 09-259712 A 10/1997
CN 101807777 A 8/2010

(Continued)

OTHER PUBLICATIONS

Chinese Office Action received in corresponding Chinese Application No. 201210550247 dated Sep. 3, 2014.

*Primary Examiner* — Truc Nguyen
(74) *Attorney, Agent, or Firm* — Mattingly & Malur, PC

(57) ABSTRACT

A gas circuit breaker comprising: a sealed tank; two breaking sections disposed in the sealed tank; a bracket to support movable parts of the breaking sections while enabling switching operation of the movable parts; an insulation cylinder to support the bracket through an electric field relaxation shield; an insulated operating rod disposed in the insulation cylinder movably in the axial direction and an end thereof is connected to an actuator; and a link mechanism connected to other end of the insulated rod and transmits drive force from the actuator to the movable parts of the breaking sections, wherein the electric field relaxation shield is provided with out-side groove and in-side groove on the insulation cylinder respectively, and the out-side groove and in-side groove are formed openings at the link mechanism side respectively, and end of the in-side groove is extended to near the outer surrounding of the insulated operating rod.

3 Claims, 4 Drawing Sheets

(56) References Cited

U.S. PATENT DOCUMENTS

| | | | | |
|---|---|---|---|---|
| 5,604,340 | A | 2/1997 | Yamada et al. | |
| 5,654,532 | A * | 8/1997 | Meyer et al. | 218/63 |
| 6,624,370 | B1 * | 9/2003 | Soga et al. | 218/43 |
| 6,660,954 | B2 * | 12/2003 | Iwabuchi et al. | 218/52 |

FOREIGN PATENT DOCUMENTS

| | | | |
|---|---|---|---|
| CN | 201601078 | U | 10/2010 |
| CN | 102013356 | A | 4/2011 |
| JP | 09-134651 | A | 5/1997 |
| JP | 2010-232032 | A | 10/2010 |

* cited by examiner

GAS CIRCUIT BREAKER

CLAIM OF PRIORITY

The present application claims priority from Japanese patent application serial No. 2011-280704, filed on Dec. 22, 2011, the content of which is hereby incorporated by reference into this application.

BACKGROUND OF THE INVENTION

1. Technical Field

The present invention relates to gas circuit breaker, and particularly to a gas circuit breaker having operating mechanism with improved insulation performance.

2. Background Art

Since breaking capacity of circuit breakers used in substations and switchyards has increased due to enlarged capacity of recent transmission systems, large capacity gas circuit breakers configured in such a way that two breaking sections are opened and closed with an actuator (hereinafter referred to as double-break gas circuit breakers) are often-used.

In FIG. 7, operating mechanism of the conventional double-break gas circuit breaker as a prior art disclosed in Patent Literature 1 is shown. A bracket 2 that is fixed and electrically insulated from a sealed tank (not shown) by an insulation support cylinder 1 is arranged in the sealed tank filled with insulation gas therein. Double-break is configured by fixed pistons 4 that slidably support puffer cylinders 3, which are movable parts of breaking sections, at right and left sides of the bracket 2. An actuator (not shown) is arranged outside the sealed tank. An insulated operating rod 5 of which a first end is connected to the actuator is used in the middle of an operation system that transmits operating force from the actuator. A second end of the insulated operating rod 5 is located near the bracket 2, and is connected to the puffer cylinders 3, which are the movable parts of the breaking sections through a link mechanism. By the insulated operating rod 5, the operating force is transmitted from the actuator to the movable parts of the breaking sections while electrical insulation between the actuator and the movable parts of the breaking sections are maintained.

A connecting pin 6 is inserted into second end part of the insulated operating rod 5, and first ends of links 7 at front and rear sides of paper of the insulated operating rod 5 are connected by means of the connecting pin 6. Second ends of the pair of links 7 are connected by another connecting pin 8, putting a triangle lever 9 between the links 7. The triangle lever 9 is connected to the movable part of the breaking section on the left of paper.

{Patent Literature 1}

Japanese Patent Laid-Open No. 2010-232032

SUMMARY OF THE INVENTION

As described above, the operating mechanism of the double-break gas circuit breaker has the complicated link mechanism. In addition, since the double-break gas circuit breaker needs to break heavy-current at high speed, it must operate the link mechanism with large operating force. For this reason, conductive particles are generated at sliding section of the link mechanism, and if the conductive particles adhere to the insulation support cylinder that maintains insulation between charged section and the actuator side, dielectric strength of the equipment deteriorates, and, in worst case, breakdown may be caused.

Moreover, the conductive particles are generated by breaking operation of each of the two breaking sections and are exhausted together with exhaust hot gas that is generated at the breaking sections. Since the breaking sections are oppositely arranged, the exhaust hot gas flows oppositely, mixes around the operating link mechanism located midway, and flows into space inside the insulation support cylinder. If this causes adhesion of the conductive particles onto the insulation support cylinder, dielectric strength of the equipment deteriorates, and, in the worst case, breakdown may be caused the same as above.

In view of these problems, an object of the present invention is to provide a gas circuit breaker for preventing the conductive particles that are generated at the time of breaking operation from adhering to the insulation support cylinder and improving insulation performance of the equipment.

A gas circuit breaker of the present invention comprising: a sealed tank filled with insulation gas therein; two breaking sections disposed in the sealed tank respectively; a bracket to support movable parts of the breaking sections configuring the two breaking sections while enabling switching operation of the movable parts of the breaking sections; an insulation cylinder to support the bracket through an electric field relaxation shield; an insulated operating rod disposed in the insulation cylinder movably in the axial direction and a first end thereof is connected to an actuator; and a link mechanism connected to a second end of the insulated rod and transmits drive force from the actuator to the movable parts of the breaking sections, wherein the electric field relaxation shield is provided with an out-side groove part and an in-side groove part on out-side and in-side of the insulation cylinder respectively, and the out-side groove part and the in-side groove part are formed openings at the link mechanism side respectively, and an end of the in-side groove part is extended to near the out-side of the insulated operating rod.

"Link mechanism" here is mechanism that is located between the insulated operating rod and the movable parts of the breaking sections and that changes axial direction movement of the insulated operating rod caused by the actuator into axial direction movement of the movable parts of the breaking sections.

Preferably, the electric field relaxation shield is characterized by having a hollow center and circular truncated cone shaped cover at the end of the in-side groove part.

Moreover, preferably, the insulated operating rod is characterized in that the operating rod has a ring shaped guide at a second end at the link mechanism side, and the guide is located above the end of the in-side groove part at the time of open action completion.

According to the present invention, reliability of gas circuit breaker can be improved because high temperature and high pressure gas flow containing the conductive particles generated at the link mechanism and the conductive particles generated at the breaking sections due to arc are prevented from flowing into the insulation support cylinder by the electric field relaxation shield that has a function of a particle trap.

DETAILED DESCRIPTION OF THE EMBODIMENTS

Embodiment 1

Figure 1:
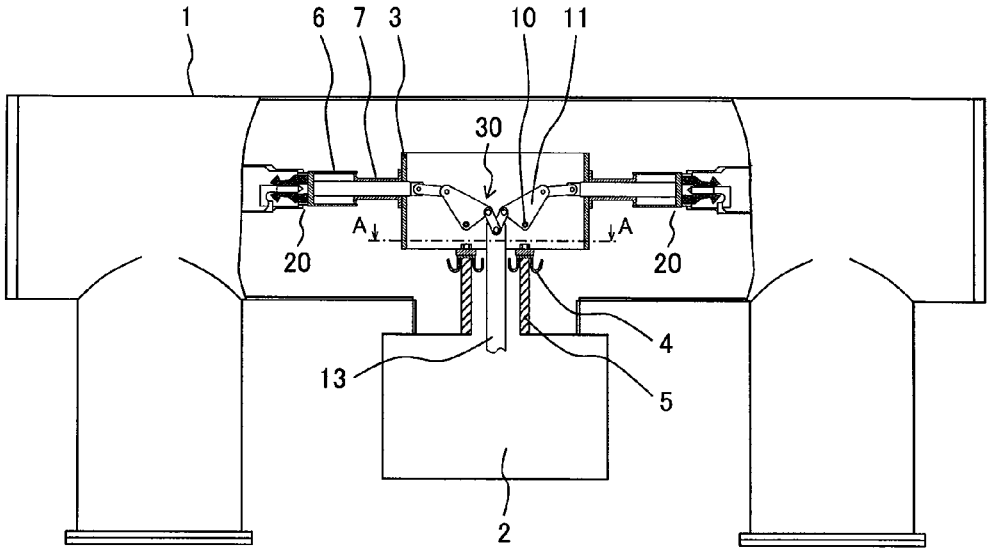
FIG. 1 is a partially cutout view showing the operating link mechanism of gas circuit breaker of a first embodiment in the present invention.

Hereinafter, a first embodiment of gas circuit breaker in the present invention is described with reference to the drawings. In FIG. 1, two breaking sections 20 and operating link mechanism 30 transmitting drive force of an actuator 2 to the breaking sections 20 are arranged in a sealed tank 1 filled with insulation gas therein. The operating link mechanism 30 is located at inside of a bracket 3. During current flowing, the operating link mechanism 30 is at high potential because it is a charged section, and potential difference exists between the operating link mechanism 30 and the sealed tank 1 at grounding potential. In order to alleviate electric field formed by the potential difference, an electric field relaxation shield 4 is fixed to an insulation support cylinder 5. In other words, the insulation support cylinder 5 retains the bracket 3 keeping electrically insulation from the sealed tank 1 with the help of the electric field relaxation shield 4.

Movable parts of breaking sections 20 are retained at both sides of the bracket 3. More particularly, puffer cylinders 6, which are the movable parts of breaking sections 20, are slidably supported by fixed pistons 7 and the fixed pistons 7 are fixed to both sides of the bracket 3 to form a double-break circuit breaker. The actuator 2 is located outside the sealed tank 1. A first end of insulated operating rod 13 is connected to the actuator 2, and the puffer cylinder 6 is connected to a second end of the insulated operating rod 13 through the operating link mechanism 30. The insulated operating rod 13 transmits operating force from the actuator 2 to the movable parts 6 of breaking sections 20 while retaining electrical insulation between the actuator 2 and the movable parts 6 of the breaking sections 20.

Figure 6:
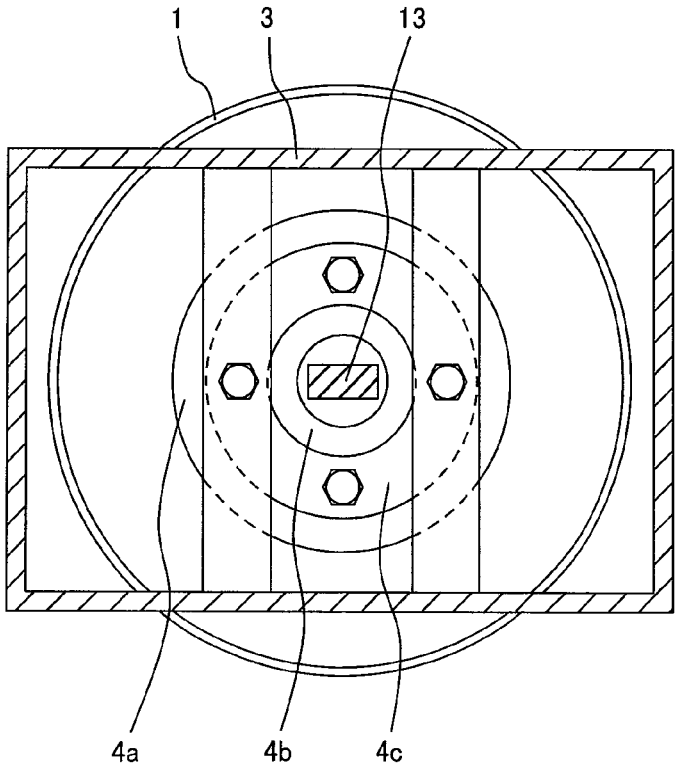
FIG. 6 is a cross-sectional view taken along the line A-A of FIG. 1.
Figure 7:
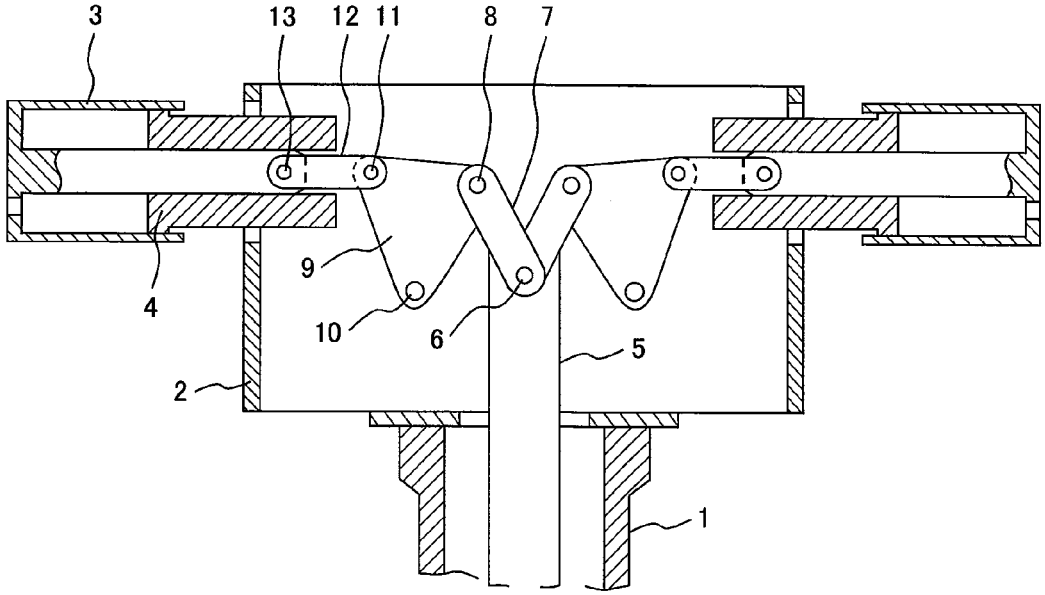
FIG. 7 (PRIOR ART)
FIG. 7 is a cross-sectional view of the operating link mechanism of a conventional double-break gas circuit breaker as a prior art.

For the bracket 3, various shapes and structures can be adopted. As shown in FIG. 6, a bracket 3 is exemplified that is box-type with top and bottom openings, has two connecting parts at the bottom, and is made of integrally molded cast iron. The two connecting parts of the bracket 3 are fixed to the insulation support cylinder 5 through the electric field relaxation shield 4 by means of bolts. Furthermore, the bracket 3 is configured in such a manner that the operating link mechanism is stored in the box form.

Figure 2:
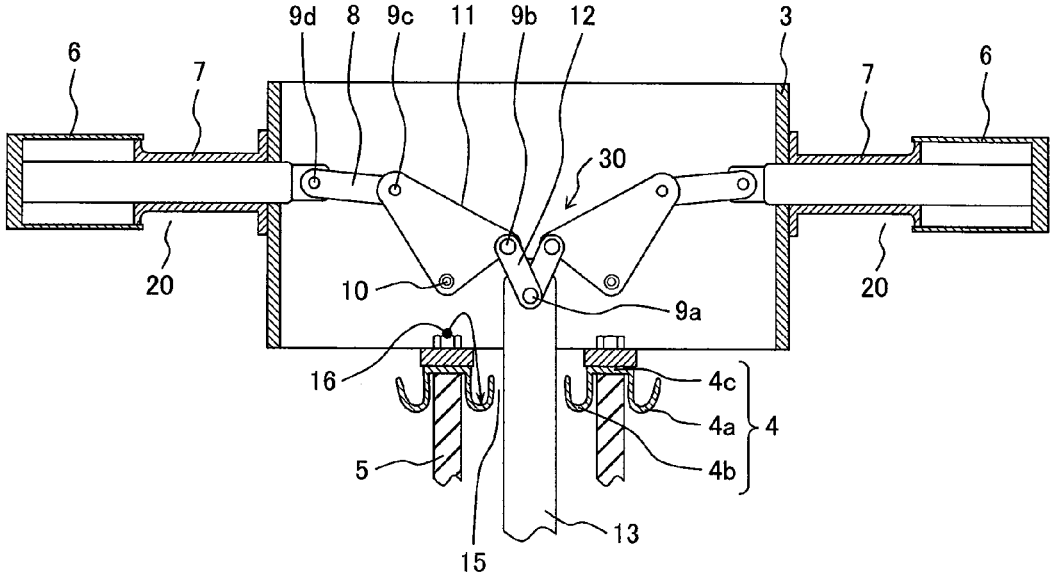
FIG. 2 is an enlarged view of the operating link mechanism of the gas circuit breaker in a first embodiment.

FIG. 2 is a substantial part enlarged view of the embodiment 1. Since structures of the breaking sections 20 and the operating link mechanism 30 which transmits operating force from the insulated operating rod 13 to the puffer cylinders 6 are symmetrical and almost the same, only left or right half of the operating link mechanism 30 is described here. Upper end of the insulated operating rod 13 is connected to a first end of a link 12 by means of a common connecting pin 9*a*, and a second end of the link 12 is connected to a triangle lever 11 for change in direction by means of a connecting pin 9*b*. The triangle lever 11 is rotatably supported from the bracket 3 by means of a rotation axis 10. In addition, the triangle lever 11 is connected to a first end of a link 8 by means of a connecting pin 9*c*, and a second end of the link 8 is connected to the shaft of the puffer cylinder 6 by means of a connecting pin 9*d*.

As described above, the bracket 3 is supported by the insulation support cylinder 5 through the electric field relaxation shield 4. The electric field relaxation shield 4 is constituted to have an out-side groove part 4*a*, an in-side groove part 4*b*, and a disk part 4*c* for connecting the both groove parts 4*a* and 4*b* in order to capture conductive particles 16 generated by the operation of the operating link mechanism 30 configured by above-mentioned connecting pins 9*a*, 9*b*, 9*c*, and 9*d*, links 8 and 12, and triangle lever 11. The electric field relaxation shield 4 is in the form of a ring, and the out-side groove part 4*a* thereof is arranged at the out-side of the insulation support cylinder 5 and the in-side groove part 4*b* thereof is arranged at the in-side of the insulation support cylinder 5. Each groove parts 4*a*, 4*b* has an opening that faces to the operating link mechanism 30. The insulated operating rod 13 passes movably in the axial direction through inside the in-side groove part 4*b* of the electric field relaxation shield 4.

Since the insulated operating rod 13 moves vertically inside the in-side groove part 4*b* of the electric field relaxation shield 4, clearance 15 is arranged between the insulated operating rod 13 and the in-side groove part 4*b*. However, in order to prevent the conductive particles 16 from falling into and adhering to the inside of the insulation support cylinder 5, the in-side groove part 4*b* is approximated to the insulated operating rod 13 to a maximum extent under the condition that the insulated operating rod 13 and the in-side groove part 4*b* do not touch mutually. In addition, the electric field relaxation shield 4 is preferable to be made of aluminum, which is excellent in conductivity, like electric field relaxation shields used ordinarily.

After the conductive particles 16 fell onto the out-side groove part 4*a* or the in-side groove part 4*b*, because the conductive particles 16 are covered with the electric field relaxation shield 4, the conductive particles 16 become less affected by electric force caused by electric field. As a result, scattering risk of the conductive particles 16 from the groove part 4*a* or 4*b* is reduced, whereby insulation performance of the equipment is maintained in a good state.

FIG. 2 shows a movement example of the conductive particles 16 when the conductive particles 16 fell from the operating link mechanism 30 side onto a bolt that fasten the bracket 3 with the disk part 4*c*. When the operating link mechanism 30 is charged, and moves the conductive particles 16 leap from on the bolt to above the in-side groove part 4*b*. After that, the conductive particles 16 fall down due to gravitational effect as shown by arrowed line to be captured in the in-side groove part 4*b*.

Also when the conductive particles 16 that fell down onto the bolt leap above the out-side groove part 4*a* side, the conductive particles 16 fall down into the out-side groove part 4*a* of the electric field relaxation shield 4 to be captured. As seen above, since the electric field relaxation shield 4 can capture the conductive particles 16 into the out-side groove part 4*a* and the in-side groove part 4*b*, insulation performance deterioration of the gas circuit breaker by the conductive particles 16 can be prevented.

In contrast, in a traditional structure having electric field relaxation shield without the function described above, because high temperature and high pressure exhaust gas containing the conductive particles generated at the operational link mechanism and the conductive particles generated at the breaking section when current is broken flows through both sides of the operating mechanism toward the insulated operating rod, there has been a risk that insulation performance is adversely affected by inflow of the high temperature and high pressure gas containing the conductive particles into the insulation support cylinder that stores the insulated operating rod.

In the structure of the present embodiment, the high temperature and high pressure gas flow containing the conductive particles 16 generated at the operating link mechanism 30 and the conductive particles 16 generated at the breaking sections 20 due to arc is prevented from flowing into the insulation support cylinder 5 by the electric field relaxation shield 4, and prevented from directly blowing toward the out-side of the insulation support cylinder 5.

With that, adhesion of the conductive particles on the insulation support cylinder 5 can be prevented, whereby reliability of gas circuit breakers can be further improved.

Embodiment 2

Figure 3:
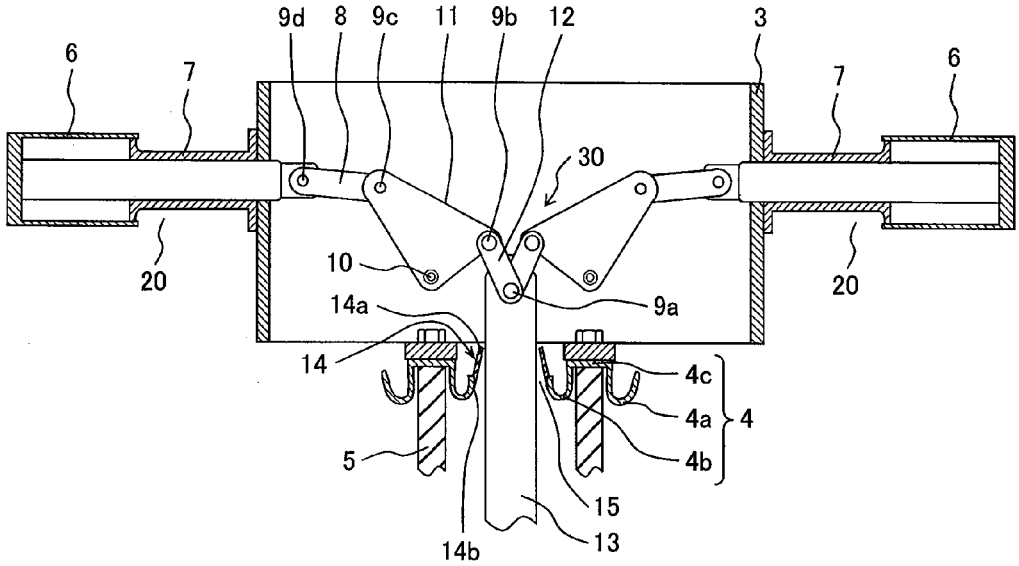
FIG. 3 is an enlarged view of the operating link mechanism of the gas circuit breaker in a second embodiment.

Hereinafter, the second embodiment of gas circuit breaker in the present invention is described based on FIG. 3. The same reference number is used for the same structure as embodiment 1 and explanation is omitted. An electric field relaxation shield 4 is configured by an out-side groove part 4*a*, an in-side groove part 4*b*, and a disk part 4*c* like the first embodiment. The electric field relaxation shield 4 according to the second embodiment of the present invention is characterized by having a hollow cover shaped with truncated circular cone at an inner surface. The cover is made of resin and shall have insulation properties.

Circular end of the in-side groove part 4*b* of the electric field relaxation shield 4 is screwed so as to fix a cover 14. In addition, a larger diameter side 14*b* of the cover 14 is also screwed so as to be fixed to the end of the in-side groove part 4*b* of the electric field relaxation shield 4 with screw clamp. When this is done, the larger diameter side 14*b* of the cover 14 can be fixed to the end of the in-side groove part 4*b* of the electric field relaxation shield 4 with screw clamp, whereby assemblage can be made easy.

In order to prevent the conductive particles 16 from getting into the insulation support cylinder 5, a clearance between a smaller diameter side 14*a* of the cover 14 and the insulated operating rod 13 is preferably narrowed to a maximum extent. However, the insulated operating rod 13 and the smaller diameter side 14*a* of the cover 14 are arranged so as not to touch with each other.

In the structure of the present embodiment, the end of the in-side groove part 4*b* of the electric field relaxation shield 4 made of aluminum needs to be circular in consideration of electric field relaxation. As shown in FIG. 6, when cross-section shape of the insulated operating rod 13 is rectangle, the clearance between the end of the in-side groove part 4*b* of the electric field relaxation shield 4 and the insulated operating rod 13 tends to be larger. Concerning this difficulty, by using the structure of the present embodiment to make the smaller diameter side 14*a* of the cover 14 as rectangle shape, the clearance between the end of the smaller diameter side 14*a* and the insulated operating rod 13 can be narrowed to a maximum extent. When this is done, the risk of the conductive particles 16 falling into and adhering to the inside of the insulation support cylinder 5 can be further reduced, whereby reliability of gas circuit breakers can be further improved.

Embodiment 3

Hereinafter, a third embodiment of gas circuit breaker in the present invention is described based on FIG. 4 and FIG. 5. The same reference number is used for the same structure as embodiment 1 and explanation is omitted. The gas circuit breaker of the Embodiment 3 in the present invention is characterized in that the conductive particles are prevented from entering into an insulation support cylinder 5 through a clearance 15 by fixing a ring-shaped guide 17 to outer circumference of an insulated operating rod 13.

Figure 4:
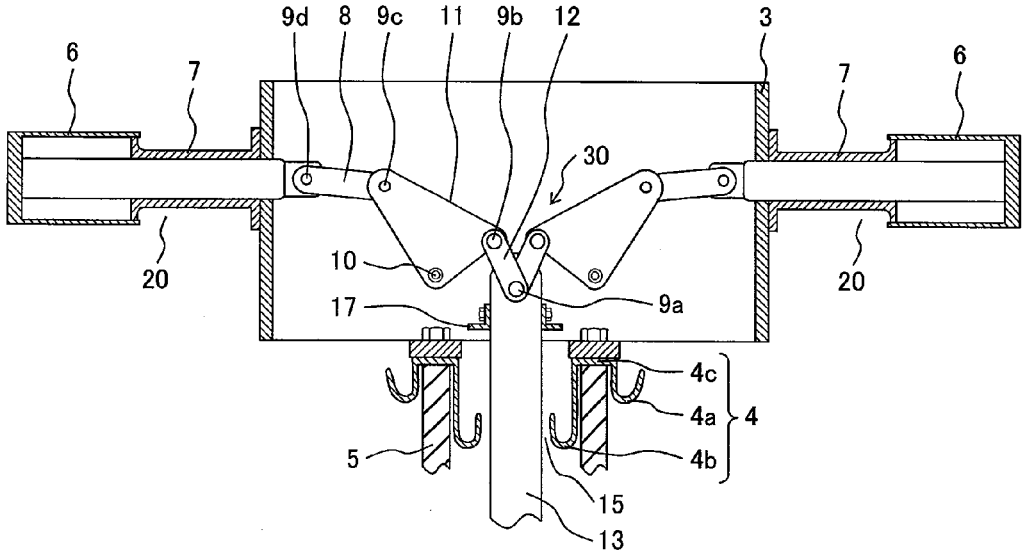
FIG. 4 is an enlarged view of the operating link mechanism of the gas circuit breaker in a third embodiment when the circuit breaker is closed.

FIG. 4 is an enlarged view of operating link mechanism 30 of gas circuit breaker of the third embodiment in the present invention when a circuit breaker is closed. The operating link mechanism 30 and the breaking section 20 are arranged in a similar way as the first embodiment. The insulated operating rod 13 has a ring-shaped guide 17 in the vicinity of connecting point of the insulated operating rod 13 and the link mechanism. The guide 17 is fixed to the insulated operating rod 13 by means of bolts, for example. For this reason, linked with axial movement of the insulated operating rod 13, the guide 17 also moves vertically by means of drive force of an actuator 2.

An electric field relaxation shield 4 is fixed to the insulation support cylinder 5. The electric field relaxation shield 4 is configured by an out-side groove part 4*a*, an in-side groove part 4*b*, and a disk part 4*c* like the first embodiment, but end of the in-side groove part 4*b* is arranged at lower position compared to the first embodiment so as not to interfere with the vertical movement of the guide 17.

Figure 5:
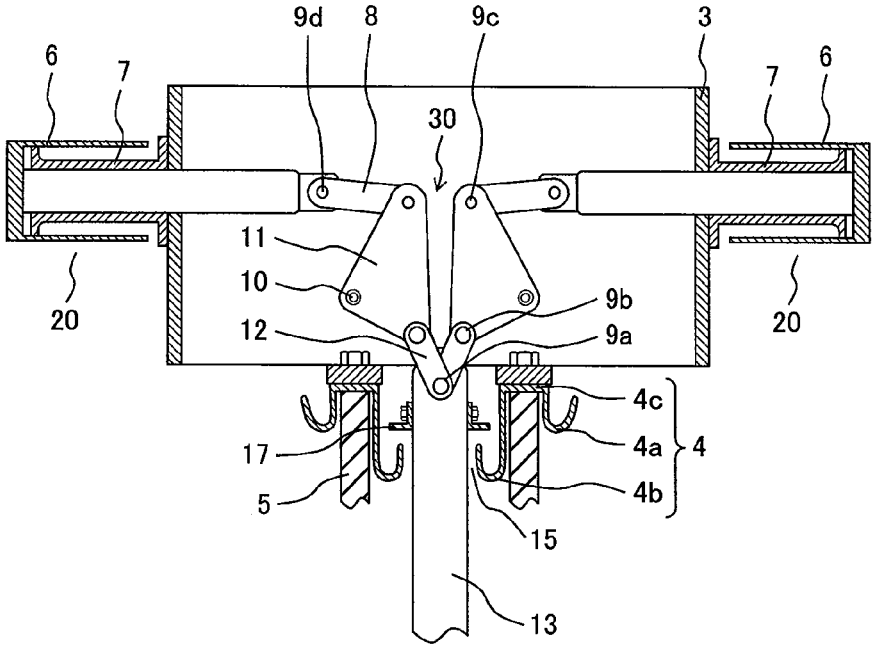
FIG. 5 is an enlarged view of the operating link mechanism of the gas circuit breaker in a third embodiment when breaking operation is complete.

FIG. 5 is an enlarged view of the operating link mechanism 30 when breaking operation of the circuit breaker is complete. In this state, as the insulated operating rod 13 has moved to the lowest position, the guide 17 also has moved to the lowest position. At this point, the in-side groove part 4*b* of the electric field relaxation shield 4 must be appropriately designed so that the end of the in-side groove part 4*b* of the electric field relaxation shield 4 may not touch with the guide 17. In order to prevent the conductive particles from getting into the insulation support cylinder 5 through a clearance 15, the clearance between the guide 17 and the in-side groove part 4*b* is preferably narrowed to a maximum extent. Moreover, in order to guarantee a function of the out-side groove part 4*a* and the in-side groove part 4*b* as a particle trap of the conductive particles, the groove parts 4*a*, 4*b* need to be deepened to a maximum extent.

By means of the structure described above, the conductive particles that fell down from the operating link mechanism 30 side into the insulation support cylinder 5 are prevented from intruding into the insulation support cylinder 5 by means of the guide 17, and finally captured into the in-side groove part 4*b*. That is to say, the risk of the conductive particles adhering to the inside of the insulation support cylinder 5 can be reduced, whereby reliability of gas circuit breakers can be improved.

The invention claimed is:

1. A gas circuit breaker comprising:

a sealed tank filled with insulation gas therein;

two breaking sections disposed in the sealed tank respectively;

a bracket to support movable parts of the breaking sections configuring the two breaking sections while enabling switching operation of the movable parts of the breaking sections;

an insulation cylinder to support the bracket through an electric field relaxation shield;

an insulated operating rod disposed in the insulation cylinder movably in the axial direction and a first end thereof is connected to an actuator; and a link mechanism connected to a second end of the insulated rod and transmits drive force from the actuator to the movable parts of the breaking sections, wherein the electric field relaxation shield is provided with an out-side groove part and an in-side groove part on outer circumference and inner circumference of the insulation cylinder respectively, and the out-side groove part and the in-side groove part are formed openings at the link mechanism side respectively, and an end of the in-side groove part is extended to near the outer surrounding of the insulated operating rod.

2. The gas circuit breaker according to claim 1, wherein the electric field relaxation shield is provided with a hollow cover shaped with truncated circular cone at an end of the in-side groove part.

3. The gas circuit breaker according to claim 1, wherein the insulated operating rod is provided with a ring shaped guide at an end thereof which is at the link mechanism side, and the ring shaped guide is located above the top of the in-side groove part when an open action has been completed.

* * * * *